US009469938B2

(12) United States Patent
Ko et al.

(10) Patent No.: US 9,469,938 B2
(45) Date of Patent: Oct. 18, 2016

(54) HEATING TEXTILE SHEET USING LIGHT

(71) Applicant: VENTEX CO., LTD., Seoul (KR)

(72) Inventors: Kung Chan Ko, Yongin-si (KR); Gwang Wung Yang, Seongnam-si (KR); Yong Hwan Rho, Incheon (KR); Eun Ho Park, Seoul (KR)

(73) Assignee: VENTEX CO., LTD., Seoul (KR)

( * ) Notice: Subject to any disclaimer, the term of this patent is extended or adjusted under 35 U.S.C. 154(b) by 0 days.

(21) Appl. No.: 14/119,340

(22) PCT Filed: Aug. 12, 2013

(86) PCT No.: PCT/KR2013/007242
§ 371 (c)(1),
(2) Date: Nov. 21, 2013

(87) PCT Pub. No.: WO2014/181927
PCT Pub. Date: Nov. 13, 2014

(65) Prior Publication Data

US 2016/0076196 A1 Mar. 17, 2016

(30) Foreign Application Priority Data

May 8, 2013 (KR) ..... 10-2013-0051908

(51) Int. Cl.

| | |
|---|---|
| ***D06P 5/00*** | (2006.01) |
| ***D06N 3/00*** | (2006.01) |
| ***D06M 11/74*** | (2006.01) |
| ***D06M 23/16*** | (2006.01) |
| ***D06P 1/00*** | (2006.01) |
| ***B41M 5/30*** | (2006.01) |
| ***B41M 5/41*** | (2006.01) |
| ***D06N 3/14*** | (2006.01) |

(52) U.S. Cl.
CPC ..... *D06N 3/0063* (2013.01); *B41M 5/30* (2013.01); *B41M 5/41* (2013.01); *D06M 11/74* (2013.01); *D06M 23/16* (2013.01); *D06N 3/14* (2013.01); *D06P 1/004* (2013.01); *D06P 5/00* (2013.01); *D10B 2501/00* (2013.01); *Y10T 428/2481* (2015.01)

(58) Field of Classification Search
CPC ..... D06P 5/00; Y10T 428/2481
USPC ..... 503/206; 428/196
See application file for complete search history.

(56) References Cited

U.S. PATENT DOCUMENTS

| | | | | |
|---|---|---|---|---|
| 8,715,790 | B2 * | 5/2014 | Silva | B82Y 30/00 427/569 |
| 2004/0248487 | A1 | 12/2004 | Yasumitsu | |
| 2006/0124028 | A1 * | 6/2006 | Huang | B82Y 30/00 106/31.92 |
| 2010/0157180 | A1 * | 6/2010 | Doane | G02F 1/1334 349/25 |

* cited by examiner

*Primary Examiner* — Bruce H Hess
(74) *Attorney, Agent, or Firm* — Polsinelli PC

(57) ABSTRACT

Disclosed herein is a textile using light. The textile unit comprises a heating unit having a shape of dot or stripe on a surface of a fabric and non-heating unit being not overlapped with the heating unit. The heating unit is formed by coating carbon nanotube (CNT) or group-4 metal carbide in a shape of dot or stripe. The heating textile sheet using light according to the present invention has excellent heat efficiency by converting light such as solar cell into thermal energy.

3 Claims, 1 Drawing Sheet

HEATING TEXTILE SHEET USING LIGHT

CROSS REFERENCE TO RELATED APPLICATIONS

This application is a National Phase filing under 35 U.S.C. §371 of PCT/KR2013/007242 filed on Aug. 12, 2013; and this application claims priority to Application No. 10-2013-0051908 filed in Republic of Korea on May 8, 2013, under 35 U.S.C. §119; the entire contents of all are hereby incorporated by reference.

TECHNICAL FIELD

The present invention relates to a heating textile sheet using light, and more particularly to a heating textile sheet using light having high warming efficiency by efficiently converting light such as solar cell into thermal energy

BACKGROUND ART

Keeping warm can be classified into two concepts. One is to prevent heat from body from being emitted to the outside, and the other is to actively applying heat to body from the outside. The former uses a thermal insulation method for insulating heat from body by air layer of fabrics, a method for using an infrared-reflecting material for not emitting radiant heat from body to the outside of clothing, and a material for absorbing body radiation energy. The latter uses electronic heating materials, chemical-reaction heat-warming materials, and solar-cell storage-heat materials in covered yarns.

In the thermal insulation method using the air layer, the thickness of fabrics increased to reduce activity. The rest of above-mentioned methods are not widely available because laundering or durability is reduced.

In the meanwhile, thermal conductivity is defined as the quantity of heat transmitted through a unit thickness in a direction normal to a surface of unit area due to a unit temperature gradient under steady state conditions and when the heat transfer is dependent only on the temperature gradient. The thermal conductivity of isotropic material is scalar, and thermal conductivity of anisotropic material is tensor. In specifically, metal has high thermal conductivity due to heat conductivity of free electron and Wiedemann-Franz Law is completed between thermal conductivity and electric conductivity. Thermal conductivity is affected by density, specific heat, and viscosity. For instance, linen fibers with high thermal conductivity are cooling fibers, and wool with low thermal conductivity is warm fibers.

Korean laid-open Patent No. 1991-3210 discloses the manufacturing method of the coated fabric in which heat insulation nature and deodorant are excellent. Concretely, the above patent relates to a manufacturing method of coating fabric for forming a coating layer by a mixture of particle obtained by sintering and grinding polyurethane solution of a solid of 30±1% using dimethyl form-amide as a solvent, microcline of 20% to 80%, beryllium oxide of 5% to 20%, zinc oxide of 5% to 15%, tin oxide of 5% to 15% and Zeolite A on a surface of a synthetic fabric. In this manufacturing method, the coating layer is formed on the fabric, so that there are disadvantages in washing and durability.

In addition, international publication No. WO 2002/34988 discloses a thermal textile made at least in part with conductive yarns for the purpose of generating heat from an electrical power source. The textile comprises has at least one conducting yarn and heater yarns have a positive temperature coefficient. This patent has disadvantages in that additional power generating structure is required, and coating compatibility is reduced.

DISCLOSURE

Technical Problem

The present invention has been made in an effort to solve the above problems, and it is an object of the present invention to provide a heating textile sheet with excellent heat being suitable for clothes without additional facilities.

It is another object of the present invention to provide a heating textile sheet using light being eco-friendly and having excellent heating efficiency by generating heat by absorbing light such as solar cell.

Technical Solution

Pursuant to embodiments of the present invention, a heating textile sheet using light comprising a heating unit having a shape of dot or stripe on a surface of the textile sheet and non-heating unit being not overlapped with the heating unit. The heating unit is formed by coating carbon nanotube (CNT) or group-4 metal carbide in a shape of dot or stripe.

Pursuant to embodiments of the present invention, the heating unit is coated by mixing the carbon nanotube and a binder.

Pursuant to embodiments of the present invention, the non-heating unit is dyed or coated as a temperature-sensitive color-changing pigment.

Pursuant to embodiments of the present invention, the temperature-sensitive color-changing pigment is discolored at a temperature of 5° C. to 40° C. and has the same color as the heating unit after discoloring.

Pursuant to embodiments of the present invention, the temperature-sensitive color-changing pigment is discolored at a temperature of 5° C. to 40° C. and has the same color as the heating unit before discoloring.

Advantageous Effects

According to the present invention, the heating textile sheet using light has excellent heating efficiency by converting absorbed light such as solar cell into thermal energy using excellent heating property of carbon nanotube (CNT) or group-4 metal carbide.

Further, the heating textile sheet according to the present invention has inherent textural features using carbon nanotube (CNT) or group-4 metal carbide.

BEST MODE

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

As used herein, the terms "about", "substantially", etc. are intended to allow some leeway in mathematical exactness to account for tolerances that are acceptable in the trade and to prevent any unconscientious violator from unduly taking advantage of the disclosure in which exact or absolute numerical values are given so as to help understand the invention.

As utilized herein, the term "fabric" is intended to include articles produced by weaving or knitting, non-woven fabrics, fiber webs, and so forth.

Figure 1:
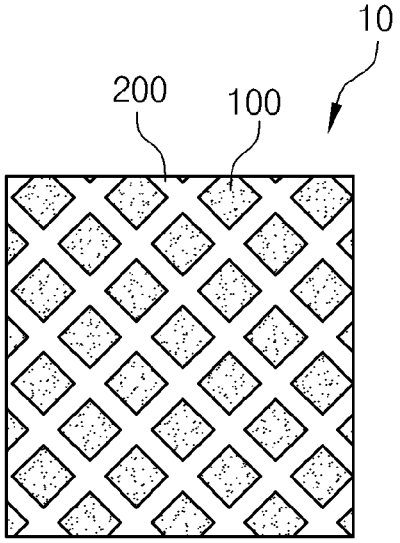
FIG. 1 shows a heating unit having a shape of dot of a heating textile sheet using light according to the present invention.
Figure 2:
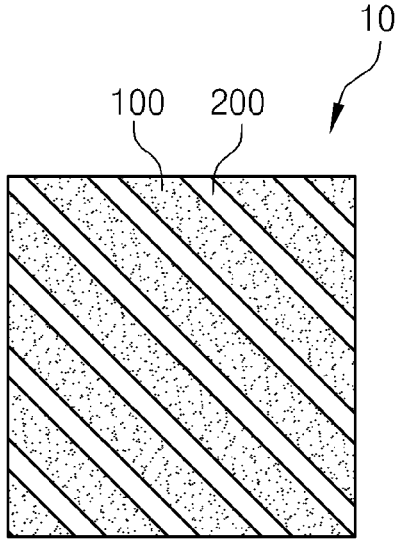
FIG. 2 shows a heating unit having a shape of stripe of a heating textile sheet using light according to the present invention.

FIG. 1 shows a heating unit having a shape of dot of a heating textile sheet using light according to the present invention. FIG. 2 shows a heating unit having a shape of stripe of a heating textile sheet using light according to the present invention.

The present invention relates to a heating textile sheet using light 10 comprising a heating unit 100 with heating function through light on a surface of a fabric.

As shown in FIGS. 1 and 2, the heating textile sheet using light 10 according to the present invention comprises the heating unit 100 having a shape of dot or stripe on a surface of a fabric and non-heating unit 200 being not overlapped with the heating unit The heating unit absorbs light to generate heat and is preferably formed by coating carbon nanotube (CNT) or group-4 metal carbide.

The CNT is a kind of carbon allotrope and are innovated electrostatic-preventing materials overwhelming prior electrostatic-suppressing materials due to excellent electrical property. The carbon-carbon bonds form a hexagon shape within the graphite sheets that rolled up into a cylinder. The diameter of CNT can vary, usually from 1-100 nanometers.

Nanotubes are categorized as single-walled nanotubes (SWNT), double-walled nanotubes (DWNT), and multi-walled nanotubes (MWNT) depending on the number of walls. SWNT, which has rarely been produced in the world, has excellent properties than MWNT. The resistance value and current carrying capability of SWNT is 1/100 times and 1,000 times as compared to copper, respectively.

CNT is two times as thermal conductivity than diamond that has most thermal conductivity in natural. Also, CNT has excellent chemical stability such as resistance property with respect to acid, base, reducing agent, and the like. Owing to strong carbon-carbon bond, the mechanical property of CNT is 50 to 100 times of high-strength alloy. CNT has hexagonal honeycomb including fine pores and hollow structure within walls, so that it has wide surface area.

If the size of CNT of the present invention is less than 2 nm, heat performance may be reduced. If the size of CNT of the present invention exceeds 10 nm, fabric feeling may be bad. Accordingly, it is preferable that the size of CNT of the present invention is ranged from 2 nm to 10 nm.

The group-4 metal carbide is transition metal and carbide of IV group in periodic table.

The group-4 metal carbide absorbs light energy of 0.3 μm to 2 μm wavelength being principal component of solar cell. Also, the group-4 metal carbide performs a function to convert and radiate the absorbed energy to thermal energy of 0.3 μm to 2 μm wavelength and reflect thermal energy of about 10 μm wavelength radiated from body.

Examples of the group-4 metal carbide are zirconium carbide, hafnium carbide, titanium, and so forth, and preferably is one of zirconium carbide, hafnium carbide, and titanium, or a two or more mixture thereof.

The group-4 metal carbide may be used as powder. If average particle size of the powder is over 20 μm, touch of the textile sheet may be reduced. For this reason, it is preferable that the powder of the group-4 metal carbide do not exceed 20 μm.

CNT or the group-4 metal carbide is mixed with acrylic-based binder, polyurethane-based binder, and silicon-based binder. Then, the mixture of CNT or the group-4 metal carbide with the binder, as shown in FIGS. 1 and 2, is coated in a shape of dot or stripe by printing or laminating on one side of the textile sheet to form heating unit.

The textile sheet used in the present invention is not easy to be dyed after forming the heating unit. Preferably, pre-dyed textile sheet is prepared.

The non-heating unit 200 may be dyed or coated as temperature-sensitive color changing pigment on a region where the heating unit is not formed for aesthetic or functionality of the textile sheet.

The temperature-sensitive color changing pigment is a pigment for revealing color in a specific temperature. If this pigment absorbs heat, its composition structure is changed to develop color or de-color. To the contrary, if the pigment blocks heat, its composition structure is reversed into original composition structure to de-color or develop color. Generally, raw materials of such temperature-sensitive color changing pigment is electron-donating orthochromatism organic composition and is consist of a donor for emitting electron and an acceptor for receiving electron. By interaction of these elements, the raw materials reveal color in crystalline structure. If heat is applied, the acceptor is separated and interaction is not performed, so that color is disappeared.

The temperature-sensitive color changing pigment comprises the electron-donating orthochromatism organic composition and electron acceptor composition. It is sensitive to external environment, and particularly very sensitive to oxygen and humidity. Thus, it is preferably used by coating low temperature thermoplastic resin. Through micro encapsulation process, it is preferably used as micro-capsule type.

In addition, color changing of temperature-sensitive color changing pigment may be clarified by adding color-developing agent and temperature-control wax in the micro-capsule.

And, various colors can be changed by revealing mixed color of general pigment and temperature-sensitive color changing pigment at a temperature in which temperature-sensitive color changing pigment reveals color.

It is preferable that since the temperature-sensitive color changing pigment becomes discolored depending on body heat or surrounding temperature, it is preferably discolored at a temperature of 5 to 40.

The temperature-sensitive color changing pigment of the non-heating unit has the same color as the heating unit after discoloring for aesthetic. Before discoloring, the non-heating unit forms patterns on the textile sheet and makes the patterns being disappeared after discoloring.

The temperature-sensitive color changing pigment of the non-heating unit has the same color as the heating unit before discoloring. Accordingly, the temperature-sensitive color changing pigment of the non-heating unit is the same as single dyed pattern before discoloring, but the non-heating unit can form patterns on the textile sheet after discoloring.

For improving processibility, a hydrophylizing process is preferably performed with respect to the textile sheet used in the heating textile sheet using light according to the present invention. The hydrophylizing process may be performed in a widely used way.

As mentioned above, the temperature-sensitive color changing pigment may be employed in the dyeing process. Through the dyeing process, color can be coated on the non-heating unit of the textile sheet.

After forming the non-heating unit in advance, the heating unit may be formed on the textile sheet by mixing CNT or the group-4 metal carbide with a binder using printing or laminating.

The binder may be acrylic-based binder, polyurethane-based binder, or silicon-based binder.

The mixing ratio of CNT or the group-4 metal carbide and the binder may be at weight ratio of 30:70 to 70:30. It is preferable that the mixing ratio of CNT or the group-4 metal carbide and the binder is coated at 5 o.w.f to 50 o.w.f (on the weight of fabric).

If the heating unit is formed of CNT, it is preferable that SWNT and MWNT are mixed at a weight ratio of 20:80 to 50:50 for embodying heat-storage function of the heating unit.

It is preferable that the heating unit is formed using printing among above-mentioned coating methods for touch of the textile sheet

MODE FOR INVENTION

Hereinafter, while this invention has been described in connection with what is presently considered to be the most practical and preferred embodiment, it is to be understood that the invention is not limited to the disclosed embodiment.

EXAMPLES

Example 1

A CNT and a polyurethane-based binder were mixed at a weight ratio of 1:1 and then coated by roll-printing way on one side of a raised brown fabric for legging to form a black-colored heating unit including CNT and a non-heating unit without CNT.

Example 2

A heating textile sheet using light was fabricated in the same manner as in Example 1, except that a temperature-sensitive color changing pigment discolored from block to pink at a temperature of 15° C. was coated on one side of the textile sheet, and CNT and the polyurethane-based binder were coated on it to form a heating unit including CNT and a non-heating unit of the temperature-sensitive color changing pigment Evaluation Experiment of Heating Using Light Experimental Method 1. Temperature and humidity in laboratory: (24±2) C, (40±5)% R.H.

2. Specimen was stabilized to have the same temperature in laboratory.

3. A bulb of 500 W was turned on apart from the specimen as much as 30 cm, thereby inducing light-heating on the specimen, and a thermometer was attached on a back of the specimen to measure temperature.

A. Evaluation of Light Heating

By the above experimental method, the light heating of textile sheets of Example and Comparative example were evaluated. Experimental results were described as the following table 1.

TABLE 1

| Time (min) | Comparative Example (° C.) | Example 1 (° C.) | Example 2 (° C.) | Temperature difference 1(° C.) (Example 1 – Comparative Example) | Temperature difference 2(° C.) (Example 2 – Comparative Example) |
|---|---|---|---|---|---|
| 0 | 24.7 | 24.8 | 24.7 | 0.1 | 0 |
| 2 | 33.4 | 43.4 | 43.1 | 10 | 9.7 |
| 4 | 34.1 | 44.2 | 43.9 | 10.1 | 9.8 |
| 6 | 34.4 | 44.7 | 44.2 | 10.3 | 9.8 |
| 8 | 34.9 | 45.5 | 44.8 | 10.6 | 9.9 |
| 10 | 35.4 | 45.6 | 45.5 | 10.2 | 10.1 |
| 20 | 36.6 | 46.5 | 46.4 | 9.9 | 9.8 |

As can be seen from Table 1, in the examples 1 and 2, bulbs were turned on, and at the same time, temperature was sharply increased within short time. We found that temperature of the textile sheet was gradually increased in comparative example in comparison with examples, and there was temperature difference over 9° C. after 20 minutes were passed.

B. Evaluation of Light Heating According to Washing

After the heating textile sheet using light of examples and the raised fabrics for legging were washed at 20 times, the same test was performed for evaluating light heating according to washing of comparative example. Experimental results were described as the following table 2.

TABLE 2

| Time (min) | Comparative Example (° C.) | Example 1 (° C.) | Example 2 (° C.) | Temperature difference 1(° C.) (Example 1 – Comparative Example) | Temperature difference 2(° C.) (Example 2 – Comparative Example) |
|---|---|---|---|---|---|
| 0 | 25.9 | 25.9 | 25.8 | 0 | −0.1 |
| 2 | 34.6 | 42.3 | 42.1 | 7.7 | 7.5 |
| 4 | 35.7 | 43.5 | 43.4 | 7.8 | 7.7 |
| 6 | 36.2 | 44.2 | 44.2 | 8 | 8 |
| 8 | 36.2 | 44.5 | 44.3 | 8.3 | 8.1 |
| 10 | 36.3 | 44.3 | 44.5 | 8 | 8.2 |
| 20 | 37.3 | 45.5 | 44.9 | 8.2 | 7.6 |

As can be seen from Table 2, in the examples 1 and 2, bulbs were turned on, and at the same time, temperature was sharply increased within short time. We found that there was temperature difference over 7° C. after 20 minutes in comparison with comparative example. Accordingly, the heating textile sheet using light according to the present invention has excellent light-heating efficiency after washing.

Although the present invention has been described herein with reference to the foregoing embodiments and the accompanying drawings, the scope of the present invention is defined by the claims that follow. Accordingly, those skilled in the art will appreciate that various substitutions, modifications and changes are possible, without departing from the spirit of the present invention as disclosed in the accompanying claims. It is to be understood that such substitutions, modifications and changes are within the scope of the present invention.

Particularly, it should, of course, be understood that the conductive fabric of the present invention can be used as a circuit board or a part of an electronic device although smart wear only has been mentioned throughout the specification.

The invention claimed is:

1. A heating textile sheet using light comprising a heating unit having a shape of dot or stripe on a surface of the textile sheet and non-heating unit being not overlapped with the heating unit, wherein the heating unit is formed by coating carbon nanotube (CNT) or group-4 metal carbide in a shape of dot or stripe; and wherein the non-heating unit a) does not comprise any carbon nanotube (CNT) or group-4 metal carbide and b) is dyed or coated as a temperature-sensitive color-changing pigment.

2. The heating textile sheet according to claim 1, wherein the temperature-sensitive color-changing pigment is discolored at a temperature of 5° C. to 40° C. and has the same color as the heating unit after discoloring.

3. The heating textile sheet according to claim 1, wherein the temperature-sensitive color-changing pigment is discolored at a temperature of 5° C. to 40° C. and has the same color as the heating unit before discoloring.

* * * * *